US009583840B1

(12) United States Patent
Lawrance

(10) Patent No.: US 9,583,840 B1
(45) Date of Patent: Feb. 28, 2017

(54) MICROWAVE ZOOM ANTENNA USING METAL PLATE LENSES

(71) Applicant: The United States of America as represented by the Secretary of the Air Force, Washington, DC (US)

(72) Inventor: Julie E. Lawrance, Albuquerque, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 129 days.

(21) Appl. No.: 14/791,086

(22) Filed: Jul. 2, 2015

(51) Int. Cl.
*H01Q 19/06* (2006.01)
*H01Q 13/02* (2006.01)

(52) U.S. Cl.
CPC ..... *H01Q 19/062* (2013.01); *H01Q 13/02* (2013.01)

(58) Field of Classification Search
CPC .. H01Q 13/0258; H01Q 15/08; H01Q 19/062; H01Q 1/185; H01Q 1/28; H01Q 21/064; H01Q 3/08
USPC ..... 343/753, 754, 781 P, 786, 911 R, 911 L
See application file for complete search history.

(56) References Cited

U.S. PATENT DOCUMENTS 2,825,063 A 2/1958 Spencer
2,994,873 A * 8/1961 Goubau ..... H01P 3/20 343/753
3,938,162 A 2/1976 Schmidt
4,070,678 A * 1/1978 Smedes ..... H01Q 3/20 343/754
4,321,604 A * 3/1982 Ajioka ..... H01Q 15/06 343/753
4,660,050 A * 4/1987 Phillips ..... F16F 15/08 343/753
5,237,334 A * 8/1993 Waters ..... H01Q 19/062 343/753
5,821,908 A * 10/1998 Sreenivas ..... H01Q 15/06 343/753
5,977,923 A 11/1999 Contu et al.
6,023,246 A * 2/2000 Tanabe ..... H01Q 19/08 343/753
6,414,646 B2 7/2002 Luh
9,496,610 B2 * 11/2016 Blech ..... H01P 1/182

* cited by examiner

*Primary Examiner* — Tho G Phan
(74) *Attorney, Agent, or Firm* — James M. Skorich

(57) ABSTRACT

A zoom antenna includes an ordinary pyramidal horn antenna with either a coaxial or waveguide feed and two parallel plate waveguide lenses (commonly referred to as "metal plate lenses") positioned with their optical axes collinear with the boresight of the pyramidal horn antenna and aligned with their plates parallel to the electric field vector. The zoom antenna outputs a collimated microwave beam having a diameter varied by translation of the lenses along boresight relative to each other and relative to the phase center of the horn antenna. The zoom antenna can be rotated to vary the azimuth and elevation angles of the collimated microwave beam produced therefrom, to thereby aim the beam in any direction.

22 Claims, 6 Drawing Sheets

MICROWAVE ZOOM ANTENNA USING METAL PLATE LENSES

STATEMENT REGARDING FEDERALLY SPONSORED RESEARCH OR DEVELOPMENT

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE INVENTION

The present invention relates to microwave antennas used in narrowband applications, and, more particularly, to a microwave antenna that incorporates parallel plate waveguide lenses, commonly referred to as "metal plate lenses," disposed in association with an ordinary pyramidal horn antenna having either a coaxial or waveguide feed, to produce a collimated microwave beam having a diameter which can be varied. A microwave is an electromagnetic wave with a wavelength in the range of 0.001 to 0.3 meters. The terms "microwave" and "electromagnetic wave" are used interchangeably herein.

BACKGROUND

It is often desirable to guide radiated energy from a narrowband high power microwave source into a collimated microwave beam radiation pattern of variable diameter which can be directed to desired azimuth and elevation angles for ground or space-based applications. For the purposes of target location, a wide antenna beam is useful for acquiring a target quickly; however, the accuracy in determining a target's position is relatively low. Zoom capability enables an operator to focus in on the target once it is acquired by continuously decreasing the diameter of the collimated microwave beam and reacquiring the target to more accurately determine its position. What is needed are high-power capabilities for zoom antennas that can greatly increase the effective range of a high power microwave source and provide variable control over an area being illuminated at large distances and in a desired direction.

Some prior "zoom" antennas use reflectors to radiate conical antenna patterns, and broaden the beam by defocusing it. These are not true zoom antennas and have a limited range due to rapid divergence of the beam. An antenna system consisting of confocal reflectors that creates a collimated microwave (or "pencil") beam radiation pattern is proposed in U.S. Pat. No. 2,825,063, issued to Roy Spencer in 1958; however, the diameter of the pencil beam cannot be varied. Another drawback to the system described in the '063 patent is feed-blockage, which is a common drawback to many reflector antennas. Another zoom antenna concept proposing the use of reflectors and a multi-beam feed is disclosed in U.S. Pat. No. 3,938,162, issued to Richard Schmidt in 1976. However, the aforementioned system requires precise synchronization of the multiple beams, which is very difficult to achieve. According to the description in the '162 patent, the radiation pattern produced by this system was "severely distorted" and "unusable as a multibeam antenna." The system also requires splitting the source energy into multiple beams and then recombining them, which makes this system very inefficient and therefore greatly reduces its effective range.

True zoom antennas that can produce a collimated beam with a variable diameter using reflectors are shown in U.S. Pat. No. 6,414,646, issued to Howard Luh in 2002, and also in the '162 patent. The concept proposed in the '162 patent consists of two parabolic reflectors with telescoping sections to vary their respective focal lengths. Zoom capability is achieved by incorporating telescoping sections into the reflectors to vary the respective shapes of the parabolic reflectors and thereby vary their focal lengths, and then repositioning the reflectors relative to each other to make them again confocal in order to achieve a collimated beam radiation pattern with a new diameter. These systems nonetheless encounter feed blockage problems and require high precision manufacturing given their required reflective properties.

What is needed in the art is a high power microwave zoom antenna that is accurate and can provide true zoom capability, yet is less costly to manufacturer and easier to implement than current microwave antenna systems.

BRIEF SUMMARY OF THE INVENTION

According to a feature of the present invention, a microwave antenna that possesses true zoom capabilities and uses two parallel plate waveguide lenses, rather than parabolic reflectors, works in conjunction with a pyramidal horn antenna to generate a collimated beam of linearly polarized electromagnetic energy that can be varied in diameter. The lenses are commonly referred to as "metal plate lenses." However, the plates do not have to be metal but may be made of any highly electrically conductive material. The current invention represents an improvement over all other prior art zoom antennas in that it does not have a feed blockage problem and does not need to be manufactured or assembled with the high precision typically required for parabolic reflector systems.

In accordance with another feature of the present invention, a zoom antenna system is proposed that will work with any narrowband microwave source, whether pulsed or continuous wave, low power or high power.

In accordance with yet another feature, the invention disclosed herein can be a true narrowband zoom antenna that can provide a variable beam diameter in a collimated microwave beam radiation pattern with linear polarization. The present invention can also be used in conjunction with any high power narrowband microwave source for ground-based space applications such as tracking or communications, and can also be used in low power narrowband applications.

In accordance with another feature of the present invention, the zoom antenna can include an ordinary pyramidal horn antenna with either a coaxial or waveguide feed and two metal plate lenses positioned with their optical axes along the linear boresight of the pyramidal horn antenna (defined herein as the axis of maximum gain of a pyramidal horn antenna). The plates comprising the parallel plate waveguide lenses are aligned parallel to the incident electric field vector to support the fundamental transverse electric ("TE1") mode of propagation between the plates comprising each lens.

In accordance with yet another feature of the present invention, the beam diameter of the collimated microwave beam radiation pattern emitted by the zoom antenna can be varied by translating the lenses along the boresight relative to each other and relative to the phase center of the pyramidal horn antenna according to basic optics equations, to achieve a collimated microwave beam output.

In accordance with yet another feature of the present invention, an entire three-element zoom antenna system presented in accordance with the teaching herein can also be rotated to vary the azimuth and elevation angles of the collimated microwave beam produced therefrom. Therefore, the system can produce a variable diameter collimated microwave beam having linear polarization in most any desired direction.

BRIEF DESCRIPTION OF THE DRAWINGS

These and other objects, features, and details of the invention will become apparent in view of the ensuing detailed disclosure, particularly in light of the drawings wherein.

DETAILED DESCRIPTION OF THE INVENTION

An objective of the present invention is to guide and control the energy radiated from a narrowband microwave source into a collimated microwave beam. The diameter of the collimated microwave beam can be varied as desired, to thereby control the area being illuminated at large distances. The present invention includes a pyramidal horn antenna and two specially designed parallel plate spherical waveguide lenses that together provide a novel way to transform energy generated by a high power microwave source into a collimated microwave beam. Collimation of the narrowband microwave energy is achieved by proper design and placement of the lenses. The diameter of the collimated microwave beam is controlled by translating these lenses relative to the phase center of a pyramidal horn antenna and relative to each other along the boresight axis of the horn antenna, with the optical axes of the lenses lying along the boresight. The entire antenna system can also be rotated in the azimuth and elevation planes to aim the collimated beam.

As stated previously, in its broadest and simplest form, the zoom antenna proposed herein consists of a pyramidal horn antenna and two specially designed parallel plate waveguide lenses. These two lenses are aligned with their respective optical axes lying along the boresight of the pyramidal horn antenna and the plates that comprise the lenses lying parallel to the electric field vector of the incident TEM wave radiated by the pyramidal horn antenna.

A pyramidal horn antenna can be used to radiate energy from any microwave source, whether it is a continuous wave or pulsed. A waveguide-fed pyramidal horn antenna is best suited for use with a very high-powered source. This antenna can radiate TEM waves with linear polarization in a conical radiation pattern with an apparent center of radiation corresponding to the phase center of the pyramidal horn, mimicking a point source located at the phase center.

Figure 1:
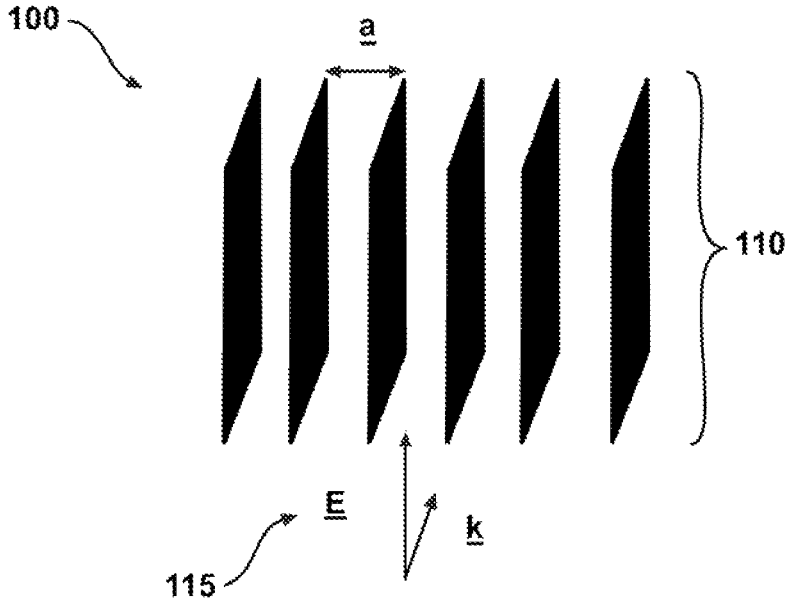
FIG. 1 is a schematic drawing of an array of highly electrically conductive rectangular parallel plates spaced a distance "a" apart, which is slightly more than half a wavelength λ of incident transverse electromagnetic ("TEM") waves, with the plates being oriented with respect to the incident linearly polarized electric field so that incident TEM waves will propagate through the plates in the fundamental TE1 parallel plate waveguide mode.

Referring to FIG. 1, shown therein is a schematic drawing of an array of metal (or otherwise highly electrically conductive) plates 110 spaced a distance "a" apart and representing the type of lens 100 that can be used in accordance with features of the present invention. The polarization of the incident electric field 115, E, must be parallel to the plates 110. The direction of propagation, k, of the incident TEM waves is into the array of plates 110, which is shown in FIG. 1 as being into the paper. If the spacing between the plates is greater than half a free space wavelength, electromagnetic energy propagates through the lens in the fundamental TE1 parallel plate waveguide mode of electromagnetic wave propagation. If there is air between the plates 110, or if any material with a relative index of refraction very close to one is located between the plates, such as a mechanical spacer, the phase velocity of the electromagnetic waves inside the lens is greater than the speed of light. The index of refraction of array 110 is therefore less than 1.

The index of refraction of any material is determined by the ratio of the speed of light to the phase velocity in the material. The result is that the parallel plate waveguide lens will have an index of refraction of between zero and one, if the material between the plates is air or any material having a relative index of refraction close to that of air. The index of refraction of lens 100 is determined by following equation, $$n = \frac{c}{v_{ph}} = \sqrt{1 - \left(\frac{\lambda}{2a}\right)^2}$$

where c is the speed of light in air;

$v_{ph}$ is the phase velocity of electromagnetic waves in the medium;

λ is the wavelength of electromagnetic waves in free space; and a is the spacing between the plates.

For the parallel plate waveguide lens, the ratio of c to $v_{ph}$ is less than one. This is in contrast to a dielectric lens through which the propagation velocity is less than the speed of light and for which the index of refraction is therefore greater than one.

Figure 2:
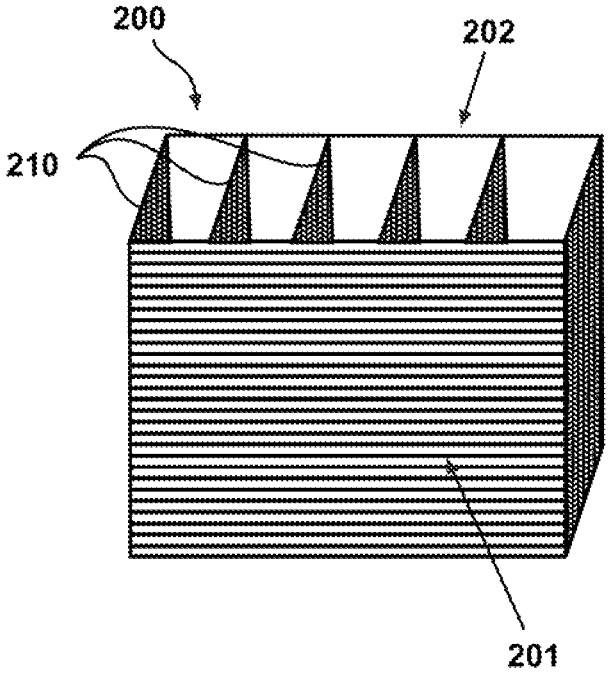
FIG. 2 is a schematic drawing of the array of parallel plates illustrated in FIG. 1, showing the front and back faces of the array.

FIG. 2 is a schematic drawing of lens 200 comprising an array of metal (or otherwise highly electrically conductive) plates 210. Lens 200 includes front face 201 and back face 202. Lens 200 can be considered as a solid with an index of refraction n less than 1. Lens 200 is shaped by carving a sphere of the desired radius out of front face 201 and also out of back face 202, of this "solid."

Figure 3:
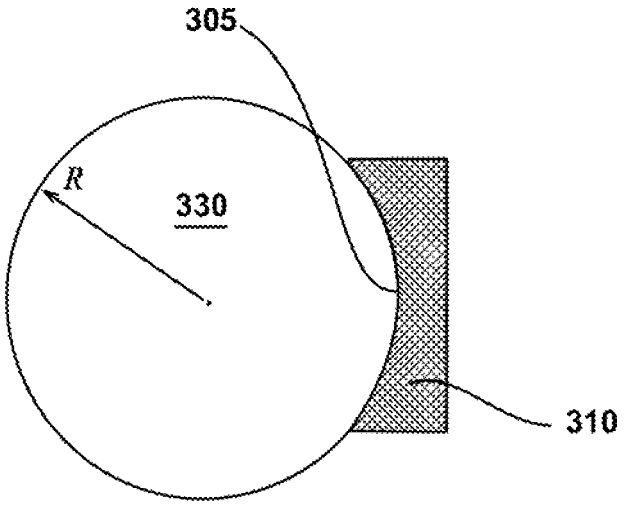
FIG. 3 is a side-view conceptual drawing showing intersection of the array of highly conductive plates with a sphere of radius R. The lens in the drawing is a simplified rendering of one face of a biconcave lens.
Figure 4:
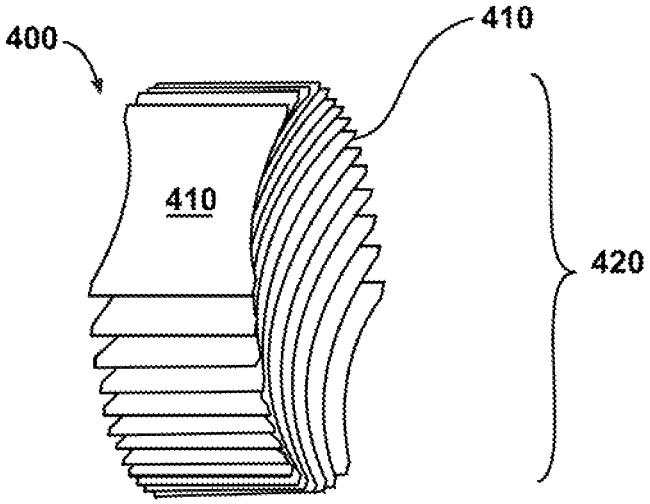
FIG. 4 is a perspective view of a biconcave spherical metal plate lens, created by removing the intersection between two spheres of radius R and the array of parallel plates, at the front and back faces of the array, respectively.

FIG. 3 is a side view schematic drawing showing intersection of front face 305 of array 310 of metal plates, with sphere 330 having a radius R. Removing sphere 330 results in a planoconcave spherical metal plate lens. Removing the same sphere 330 from the back face of array 310 results in a biconcave spherical metal plate lens. FIG. 4 is a perspective view of biconcave spherical metal plate lens 400 comprised of an array of metal (or otherwise highly electrically conductive) plates 410. Also shown is concave front face 420.

Figure 5:
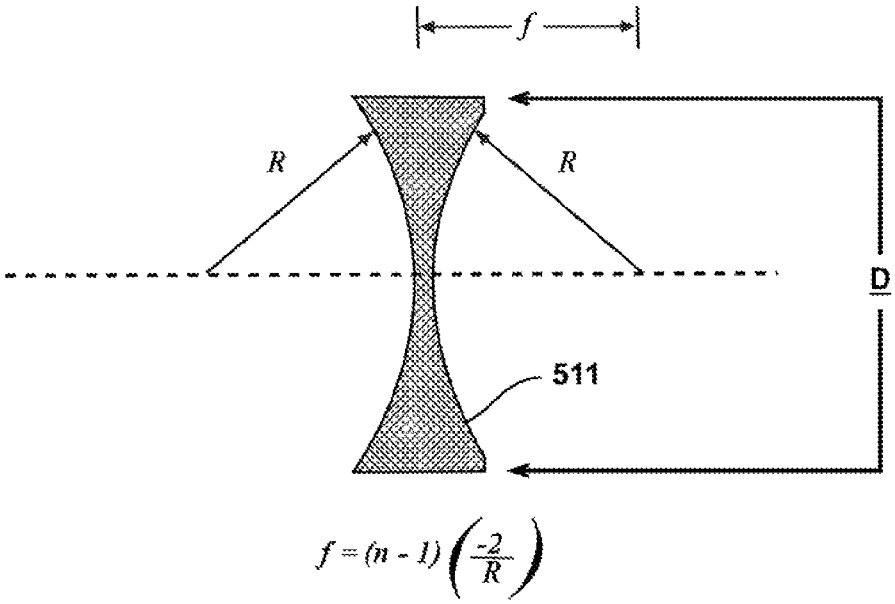
FIG. 5 is a schematic drawing of a biconcave spherical parallel plate waveguide lens indicating its focal length f, which is dependent on both the index of refraction n and the radius of curvature R. The diameter of the lens is indicated by D.

FIG. 5 is a schematic side view of a biconcave spherical parallel plate waveguide lens 511 having a focal length f. For simplification, the drawing indicates a generic biconcave lens; however, in reality lens 511 is a shaped array of parallel plates similar to lens 400 shown in FIG. 4. The focal length f is dependent on both the index of refraction n, which is less than one, and the radius of curvature R, according to the thin lens approximation to the lens makers' equation. Sign convention for concave lenses is applied to the thin lens approximation to the lens makers' equation, which results in a positive focal length f for biconcave lens 511 with an index of refraction n less than 1. The lens diameter is indicated by D.

Figure 6:
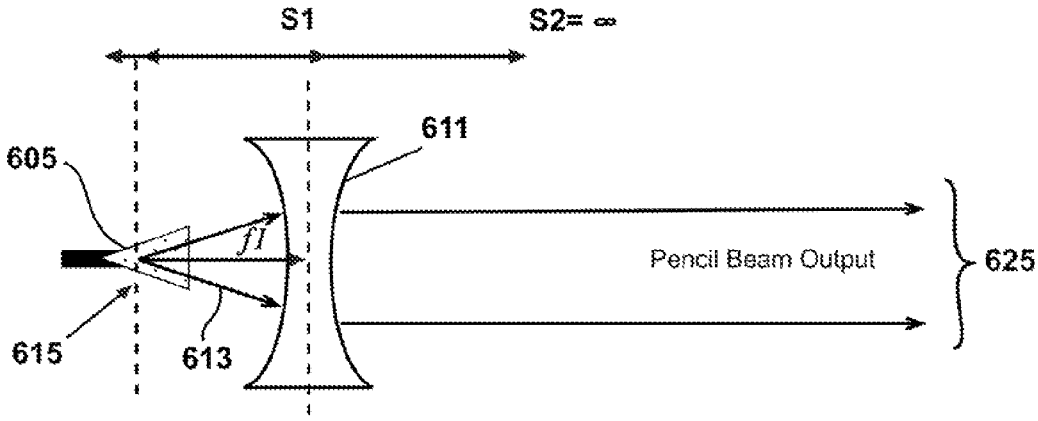
FIG. 6 is a schematic drawing showing that an emitted beam is collimated when the biconcave lens is placed one focal length, indicated by f1, from the phase center of a pyramidal horn antenna.

FIG. 6 is a schematic drawing showing pyramidal horn antenna 605 and biconcave lens 611, indicating that a beam 613 is collimated when lens 611 is placed one focal length f1 from phase center 615 of pyramidal horn antenna 605. According to the thin lens equation, if the distance from a point source to the lens, S1, is equal to its focal length, the distance from the lens to the focal plane, S2, is infinity. Therefore, with lens 611 placed one focal length from a point source, all of the incident electromagnetic energy is collimated into beam 625, whose diameter is equal to the diameter of beam 613 at its interception with lens 611.

Figure 7:
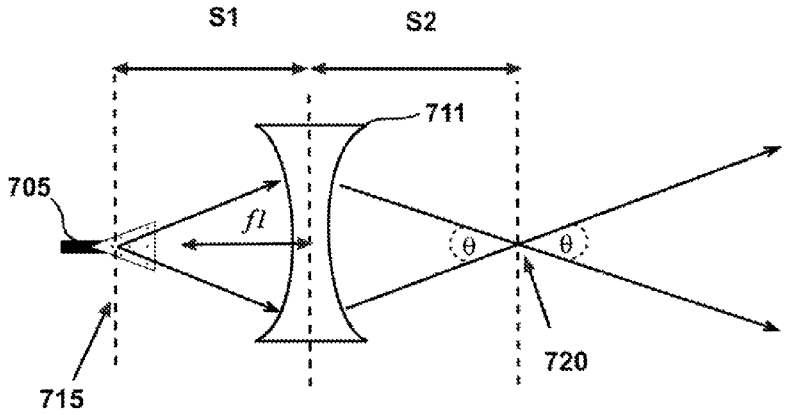
FIG. 7 is a schematic drawing of a parallel plate waveguide lens with a focal length of f1 placed a distance S1 from the phase center of a pyramidal horn antenna, where S1 is greater than f1, indicating that the electromagnetic waves are focused at distance S2 from the lens.

FIG. 7 is a schematic drawing of biconcave metal (or otherwise highly electrically conductive) plate lens 711 with a focal length f1, located a distance S1 from the phase center of pyramidal horn antenna 705, for which S1 is greater than f1. In this case, the distance from lens 711 to the focal plane, S2, is finite and the electromagnetic energy is focused at Airy disc 720. Electromagnetic waves will diverge from the focal plane of Airy disc 720 at the angle of convergence, θ, from the lens 711 to the focal plane of Airy disc 720.

The shaping of a lens to achieve a desired focal length is determined from the lens makers' equation, as previously mentioned. It is sufficient to use the thin lens approximation to this equation given by, $$\frac{1}{f} = (n-1)\left[\frac{1}{R1} - \frac{1}{R2}\right]$$

where f is the focal length;

n is the index of refraction; and

R1 and R2 are the radii of curvature of a biconcave spherical lens.

Figure 8:
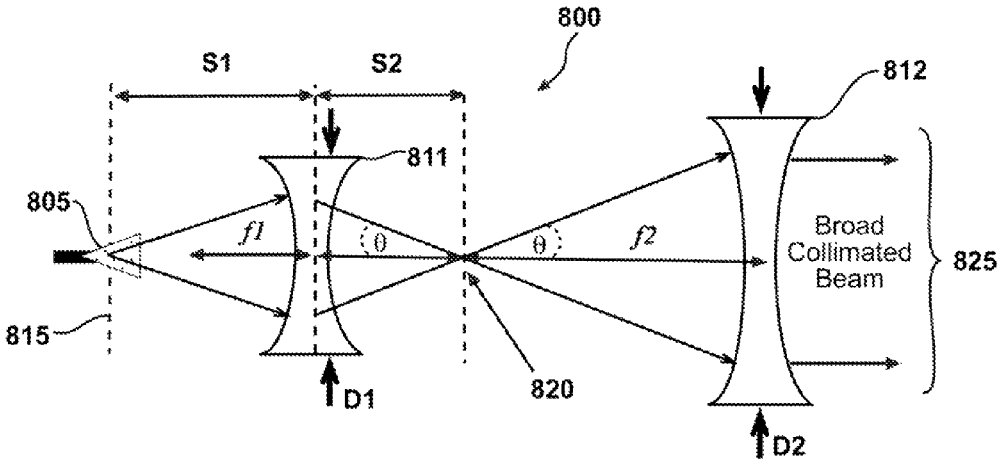
FIG. 8 is a schematic drawing of the zoom antenna disclosed herein showing placement of two parallel plate spherical biconcave waveguide lenses relative to the phase center of a pyramidal horn antenna and relative to each other to generate a relatively broad collimated microwave beam having linear polarization. Both lenses are positioned with their optical axes along the boresight of the pyramidal horn antenna and oriented to support the TE1 mode of electromagnetic wave propagation between the lens plates.

Referring to FIG. 8, for zoom antenna 800 shown therein, at least two lenses, 811, 812, are used in association with pyramidal horn antenna 805. First lens 811 is located closer to pyramidal horn antenna 805 than second lens 812. The diameter and focal length of lens 811 are D1 and f1, respectively. The diameter and focal length of lens 812 are D2 and f2, respectively. Diameter D2 is greater than diameter D1, and focal length f2 is greater than focal length f1. The optical axes of the lenses are collinear with each other and with the boresight of pyramidal horn antenna 805, and are oriented such that they support the TE1 mode of electromagnetic wave propagation in the lenses. The phase center of pyramidal horn antenna 805 lies in plane 815.

A thin lens placed a distance equal to its focal length, f, from a point source, will collimate an incident beam. If the thin lens is placed a distance S1 from the point source that is greater than its focal length, the lens will focus energy from the point source in a focal plane at distance S2 from the lens. The relationship between f, S1 and S2 is governed by the following equation:

$$\frac{1}{f} = \frac{1}{S1} + \frac{1}{S2}$$

Accordingly, since f is constant, as S1 increases, S2 decreases.

Due to diffraction limits, the energy will be focused in the focal plane at S2 at Airy disc 820, whose diameter, x, is determined by the following equation, where f is the focal length, D1 is the diameter of lens 811 and λ is the free space wavelength of the electromagnetic waves:

$$x = 1.22\frac{\lambda f}{D1}$$

The diameter x of the Airy disc for the proposed system will be on the order of a wavelength of the electromagnetic waves. The angle of divergence, θ, of the electromagnetic waves beyond the focal plane at Airy disc 820 is equal to the angle of convergence, also denoted as θ, from the lens 811 to the focal plane at Airy disc 820.

For the zoom antenna 800, lens 812 is located a focal length, f2, from Airy disc 820 produced by lens 811. The resulting output of the entire antenna system 800 is a relatively broad collimated beam 825, whose diameter can be varied by varying S1 and subsequently adjusting the position of lens 812 along the boresight, so that it remains at focal length f2 apart from Airy disc 820. For example, as S1 is increased beyond a nominal value which is greater than f1, the diameter of the conical beam radiated from horn antenna 805 also increases. The diameter D1 of lens 811 must therefore be large enough to intercept most of the microwaves radiated from horn antenna 805. In addition, the angle of convergence θ of the microwaves emanating from lens 811 to Airy disc 820 increases as S1 increases, as does the angle of divergence θ from the plane of Airy disc 820. S2 consequently decreases and lens 812 is moved closer to lens 811 so that it remains spaced apart one focal length f2 from Airy disc 820 created by lens 811; therefore, beam 825 remains collimated, but with an increased diameter. The diameter D2 of lens 812 should be sufficient to intercept most of the diverging electromagnetic energy at the location of lens 812.

For practical applications, it is found that a biconcave lens design, with R1=R2, is most appropriate for lens 811 and either a biconcave or planoconcave lens design is appropriate for lens 812.

The magnification, M, of zoom antenna 800 is the ratio of the diameter of collimated microwave beam 825 to the diameter of the beam intercepted by lens 811, and is given by the equation, $$M = \frac{f2}{S2} = \frac{(f2)(S1 - f1)}{(f1)(S1)}$$

where

S1 is the distance from a point source corresponding to the phase center of pyramidal horn antenna 805, to lens 811;

f1 is the focal length of lens 811;

S2 is the distance from lens 811 to Airy disc 820 created by lens 811, when lens 811 is placed a distance S1 greater than f1; and f2 is the focal length of lens 812.

Note that if S1=f1, S1−f1=0. In this case, output of the zoom antenna will not be a collimated beam. S1 must always be greater than f1 to achieve a collimated beam output.

Figure 9:
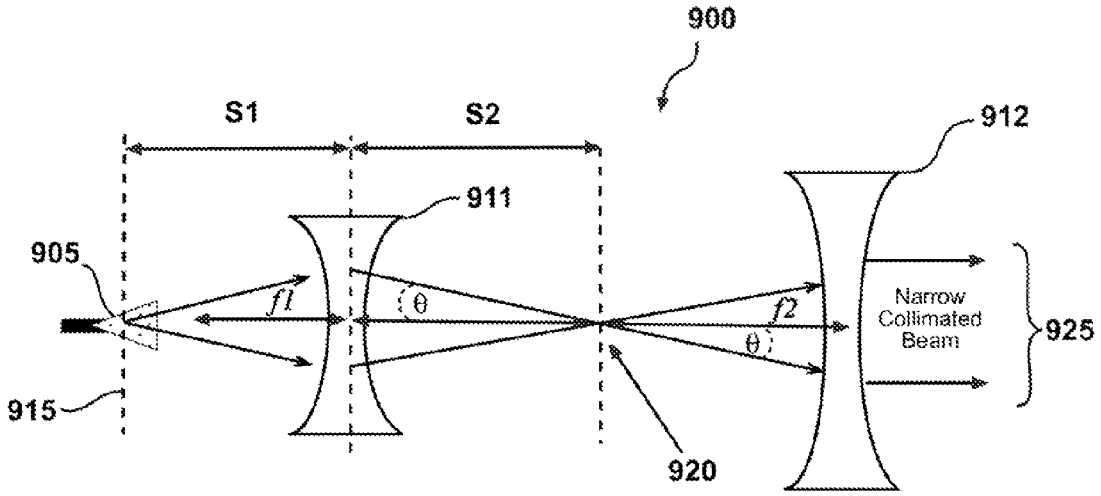
FIG. 9 is a schematic drawing of another embodiment of the zoom antenna proposed herein showing placement of the lenses relative to a pyramidal horn antenna and relative to each other to produce a relatively narrow collimated microwave beam having linear polarization.

FIG. 9 is a schematic drawing of zoom antenna 900 of the present invention where S1, while remaining greater than f1, is less than the pyramidal horn antenna-to-lens distance S1 of zoom antenna system 800 shown in FIG. 8. Relative to zoom antenna 800, the angle of convergence θ decreases and the distance S2 from lens 911 to Airy disc 920 increases. Lens 2 is then repositioned to remain at a focal length f2 apart from Airy disc 920. The result is a narrowing of collimated beam 925. As shown by comparing antennas 800 and 900 respectively shown in FIGS. 8 and 9, control of the output beam diameter is achieved by translating the lens nearest to the horn antenna, e.g., lenses 811 and 911, relative to the phase center of the pyramidal horn antenna along the boresight, then translating the further lens, e.g., lenses 812 and 912, along the boresight so that it is always one focal length f2 spaced apart from the Airy disc created by the nearer lens.

Figure 10:
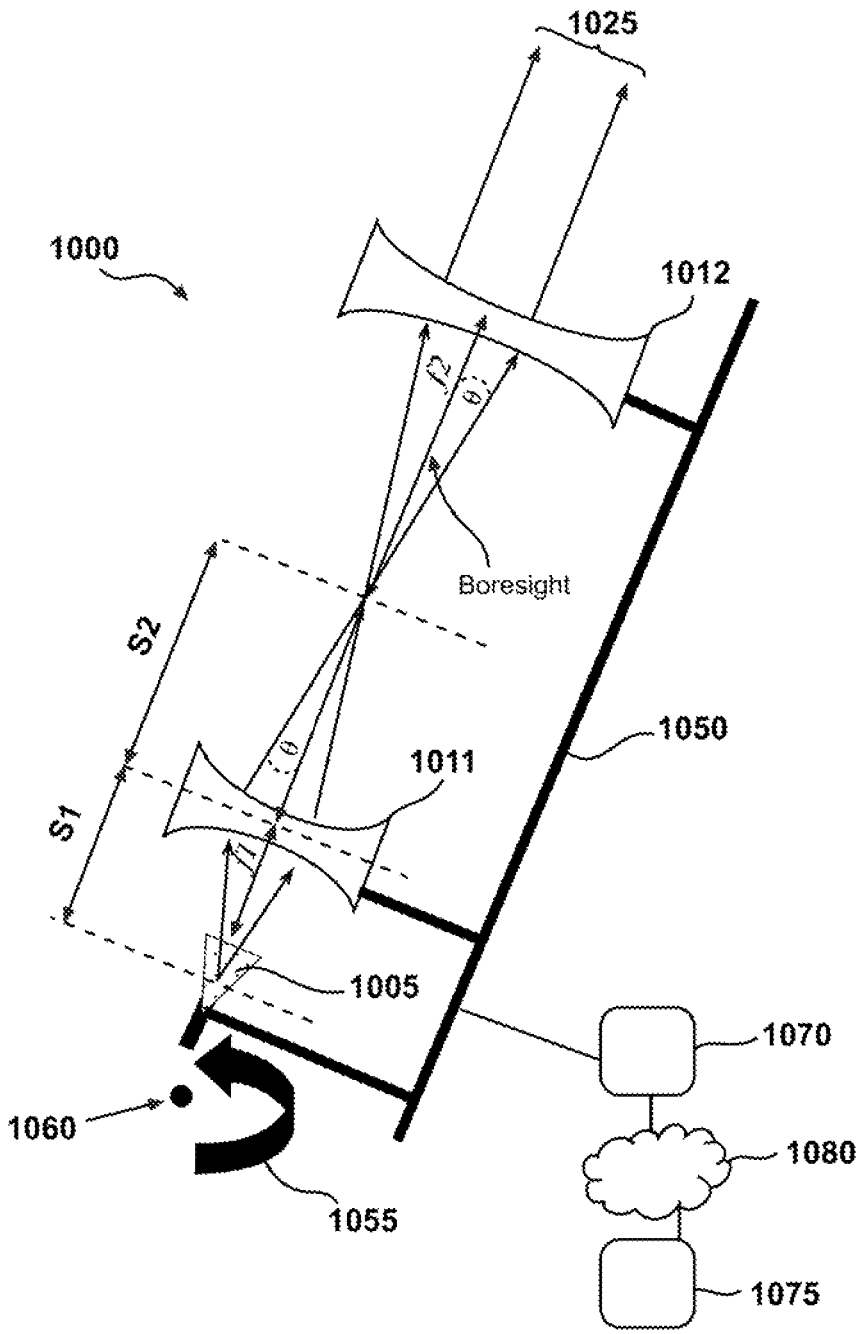
FIG. 10 is a schematic drawing of a zoom antenna of the present invention incorporating a coupling mechanism and a pivot for rotating the antenna.

FIG. 10 is a schematic drawing of zoom antenna 1000 of the present invention. Coupling mechanism 1050 couples pyramidal horn antenna 1005 and two lenses, 1011, 1012, to limit the motion of lenses 1011, 1012 to translation along the boresight axis, relative to pyramidal horn antenna 1005. Rotation mechanism 1055 located at pivot point 1060 provides for rotation of zoom antenna 1000 subtended by the angles corresponding to azimuth and elevation. Translation mechanisms at both lenses 1011 and 1012 translate lenses 1011, 1012 along the boresight relative to pyramidal horn antenna 1005 and to each other, to generate collimated microwave beam 1025 having a diameter which is varied by the foregoing translation. Any suitable mechanical or electromechanical means for translating lenses 1011, 1012 along the boresight axis relative to each other and to horn antenna 1005 in order to continuously or incrementally vary the diameter of beam 1025 can be used. For example, lens 1011 and lens 1012 could be independently moved along a track or rod by geared or screw-driven mechanisms. Their translation can be controlled by local computer 1070, and can also be remotely controlled by remote computer or server 1075, or a server over network 1080.

Any suitable mechanical or electromechanical means 1055 can be employed to rotate and/or pivot zoom antenna system 1000 about pivot point 1060 in the azimuth and elevation planes, to vary the direction of the pencil beam 1025. Mechanical or electromechanical means 1055, and thus the direction of collimated microwave beam 1025, can be controlled by local computer 1070, and can also be remotely by remote computer or server 1075 over network 1080.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A microwave zoom antenna comprising:

a pyramidal horn antenna for radiating linearly polarized transverse electromagnetic waves in a conical radiation pattern;

a first waveguide lens being spaced apart from the horn antenna by an adjustable first distance and having a first focal length, for intercepting the electromagnetic waves and focusing the intercepted electromagnetic waves at an Airy disc in a focal plane;

a second waveguide lens having a second focal length, for intercepting the electromagnetic waves emanating from the first lens, and being located at an adjustable position relative to the first lens; and the position being adjusted to maintain the second lens at a spacing apart from the Airy disc equal to the second focal length, whereby a collimated beam of electromagnetic waves is emitted from the second lens.

2. The zoom antenna recited in claim 1, wherein the collimated beam has a beam diameter that is a function of the first distance.

3. The zoom antenna recited in claim 1, wherein:

the first distance is greater than the first focal length; and the collimated beam has a beam diameter that is a function of the first distance and the first focal length.

4. The zoom antenna recited in claim 1, wherein:

the pyramidal horn antenna has a linear boresight; and further comprising a translation mechanism for translating the first lens and the second lens along the boresight, relative to each other and relative to the pyramidal horn antenna.

5. The zoom antenna recited in claim 1, further comprising:

a rotation mechanism attached to the zoom antenna for rotating the zoom antenna, whereby the collimated beam can be rotated through an azimuth angle and an elevation angle.

6. The zoom antenna recited in claim 1, wherein:

the pyramidal horn antenna has a gain and either a coaxial or waveguide feed; and the electromagnetic waves radiated from the pyramidal horn antenna have a half power beamwidth related to the gain.

7. The zoom antenna recited in claim 1 wherein the first lens is a parallel plate waveguide lens having a first diameter of sufficient magnitude to intercept most of the electromagnetic waves radiated from the pyramidal horn antenna.

8. The zoom antenna recited in claim 7, wherein:

the second lens is a parallel plate waveguide lens with a second diameter; and the second diameter is of sufficient magnitude to intercept most of the electromagnetic waves emanating from the first lens.

9. The zoom antenna recited in claim 1, wherein the first and second lenses are comprised of parallel plates which are electrically conductive.

10. A zoom antenna for radiating a collimated microwave beam having a variable breadth, comprising:

first and second lenses formed from electrically conductive material, with each of the lenses having two surfaces respectively facing in opposing directions;

a source for radiating microwaves in a conical radiation pattern about a linear boresight;

the first lens being biconcave, having a first center intersecting the boresight, with the first center lying at a variable first distance measured along the boresight from the source, and including a proximal first lens surface and a distal first lens surface, with the proximal first lens surface lying nearer to the source than the distal first lens surface and having a first focal length;

the second lens having a second center intersecting the boresight, and including a proximal concave second lens surface and a distal second lens surface, with the proximal concave second lens surface lying nearer to the source than the distal second lens surface and having a second focal length;

the first lens being for focusing electromagnetic waves from the source and creating an Airy disc intersecting the boresight;

the second lens having an adjustable position on the boresight relative to the first lens, and for being maintained at a spacing apart from the Airy disc equal to the second focal length; and the second lens being for radiating a collimated beam from the distal second lens surface, with the collimated microwave beam having a breadth which is variable as a function of the first distance.

11. The zoom antenna as defined in claim 10 wherein the first distance is greater than the first focal length.

12. The zoom antenna as defined in claim 11 wherein the breadth of the collimated beam is variable as a function of the first distance and the first focal length.

13. The zoom antenna as defined in claim 12 wherein the Airy disc is located at a variable third distance along the boresight from the first center, with the third distance being a function of the first distance and the first focal length.

14. The zoom antenna as defined in claim 10 wherein:

the first center is equidistant from the proximal and distal first lens surfaces; and the proximal first lens surface and the distal first lens surface are each radially symmetric about the boresight.

15. The zoom antenna as defined in claim 10 wherein the proximal first lens surface has a breadth sufficient to intercept most of the microwaves emanating from the source.

16. The zoom antenna as defined in claim 10 wherein:

the distal second lens surface is planar, whereby the second lens is planoconcave.

17. The zoom antenna as defined in claim 10 wherein:

the distal second lens surface is concave;

the second center is equidistant from the proximal second lens surface and the distal second lens surface, whereby the second lens is biconcave; and the proximal second lens surface and the distal second lens surface are each radially symmetric about the boresight.

18. The zoom antenna as defined in claim 10 wherein the proximal second lens surface has a breadth sufficient to intercept most of the microwaves being emitted from the distal first lens surface.

19. The zoom antenna as defined in claim 10 further comprising:

a pyramidal horn antenna; wherein the source is approximated as a point source corresponding to an approximate phase center of the pyramidal horn antenna.

20. The zoom antenna as defined in claim 19 wherein:

the pyramidal horn antenna has a gain and either a coaxial or waveguide feed; and electromagnetic waves radiated from the pyramidal horn antenna have a half power beamwidth related to the gain.

21. The zoom antenna recited in claim 10, further comprising a translation mechanism for translating the first lens and the second lens along the boresight, relative to each other and relative to the source.

22. The zoom antenna recited in claim 10, further comprising:

a rotational mechanism attached to the zoom antenna for rotating the zoom antenna, whereby the collimated beam can be rotated through an azimuth angle and an elevation angle.

* * * * *